US011175032B1

(12) United States Patent
Yang

(10) Patent No.: US 11,175,032 B1
(45) Date of Patent: Nov. 16, 2021

(54) WATER LAMP

(71) Applicant: Tung-Yao Yang, Tainan (TW)

(72) Inventor: Tung-Yao Yang, Tainan (TW)

( * ) Notice: Subject to any disclaimer, the term of this patent is extended or adjusted under 35 U.S.C. 154(b) by 0 days.

(21) Appl. No.: 17/009,736

(22) Filed: Sep. 1, 2020

(51) Int. Cl.

| | |
|---|---|
| ***F21V 33/00*** | (2006.01) |
| ***F21V 23/00*** | (2015.01) |
| ***F21V 23/04*** | (2006.01) |
| ***G09F 13/04*** | (2006.01) |
| ***F21V 31/00*** | (2006.01) |
| *F21Y 115/10* | (2016.01) |

(52) U.S. Cl.
CPC ..... *F21V 33/0004* (2013.01); *F21V 23/002* (2013.01); *F21V 23/04* (2013.01); *F21V 31/00* (2013.01); *G09F 13/04* (2013.01); *F21Y 2115/10* (2016.08)

(58) Field of Classification Search
CPC .... F21V 33/0004; F21V 23/002; F21V 23/04; F21V 31/00; F21V 33/0028; F21V 33/0024; F21V 31/005; F21V 31/04; F21V 3/00; F21V 3/06; F21V 3/0615; F21V 3/0625; G09F 13/04; F21Y 2115/10
See application file for complete search history.

(56) References Cited

U.S. PATENT DOCUMENTS

| | | | | |
|---|---|---|---|---|
| 6,039,453 | A * | 3/2000 | Wang | F21S 10/002 362/101 |
| 6,135,604 | A * | 10/2000 | Lin | H05B 45/20 362/101 |
| 6,499,854 | B2 * | 12/2002 | Chen | F21S 6/002 362/101 |
| 8,158,066 | B2 * | 4/2012 | Yang | A61L 9/122 422/124 |
| 9,222,663 | B1 * | 12/2015 | Yang | F21V 31/04 |
| 2014/0268668 | A1 * | 9/2014 | Yang | F21S 10/002 362/101 |
| 2019/0249838 | A1 * | 8/2019 | Wang | G02B 6/0091 |

* cited by examiner

*Primary Examiner* — Bao Q Truong
(74) *Attorney, Agent, or Firm* — Leong C. Lei

(57) ABSTRACT

The water lamp includes a casing, a lighting member, a cap, and a decorative element. The casing has an accommodation space inside filled with a fluid and a through opening on a bottom side. The lighting member positioned in the accommodation space, including at least one lighting element on a top side and a number of columns and a tube arranged at intervals on a bottom side. The translucent cap has an open bottom receiving the top side of the lighting member. The cap and the lighting member jointly enclose a watertight space. The decorative element has a three-dimensional shape having a chamber on a bottom side for covering the cap. As such, the lighting elements are isolated in the watertight space and separated from the fluid in the casing. Through a power element, the lighting elements may illuminate from inside the casing element, thereby creasing interesting visual effect.

7 Claims, 9 Drawing Sheets

WATER LAMP

BACKGROUND OF THE INVENTION

(a) Technical Field of the Invention

The present invention is generally related to lamps, and more particular to a water lamp.

(b) Description of the Prior Art

A water lamp is a common decoration in households. By having internal fluid blended with glittering powders and sequins, the water lamp provides varying visual effect and appeal.

Usually, lighting for the water lamp is provided from a base of the water lamp so as to avoid contact with the fluid, and light has to be projected upward from the base and scattered into the water lamp. The visual effect is often compromised due to this waterproof design.

SUMMARY OF THE INVENTION

Therefore, a novel water lamp is provided herein, which mainly includes:

a translucent casing having an accommodation space inside filled with a fluid and a through opening on a bottom side;

a lighting member positioned in the accommodation space, including at least one lighting element on a top side and a number of columns and a tube arranged at intervals on a bottom side, where the columns have their bottom ends fixedly joined to the cover, and the tube is extended through and tightly fills the through hole, the tube has an axial channel, and a cable runs through and connects the at least one lighting elements to a power element;

a translucent cap having an open bottom receiving the top side of the lighting member, where the cap and the lighting member jointly enclose a watertight space, and the at least one lighting element and the channel are enclosed in the watertight space; and;

a translucent decorative element having a three-dimensional shape having a chamber on a bottom side for covering and joining onto the cap.

As such, the lighting elements are housed in the watertight space and separated from the fluid in the casing. Through the power element, the lighting elements may illuminate from inside the casing element, thereby creasing interesting visual effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
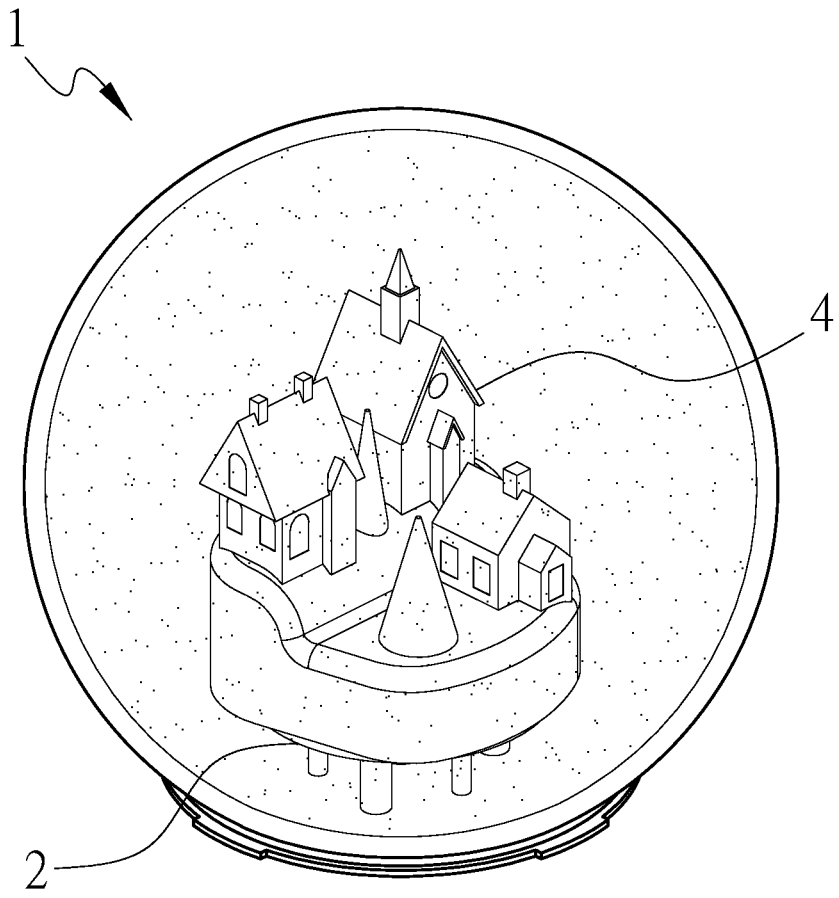
FIG. 1 is a perspective diagram showing a water lamp according to an embodiment of the present invention.
Figure 2:
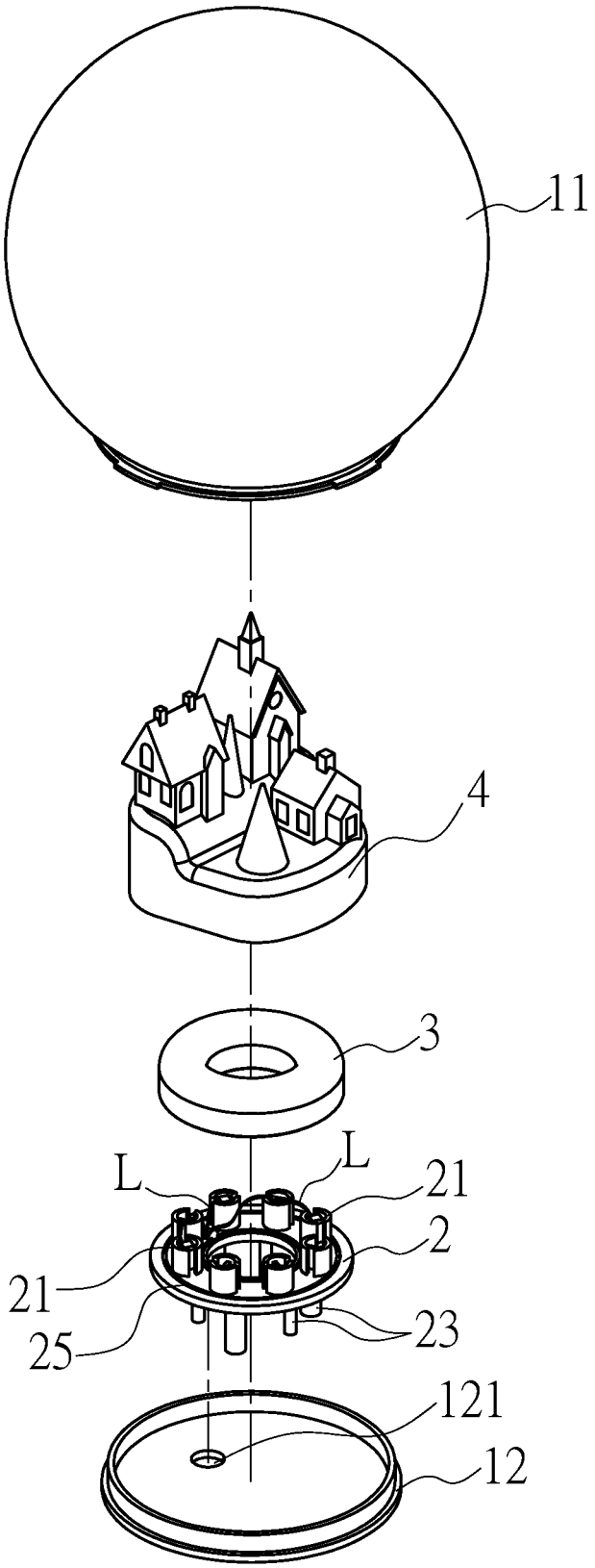
FIG. 2 is a perspective break-down diagram showing the water lamp of FIG. 1.
Figure 3:
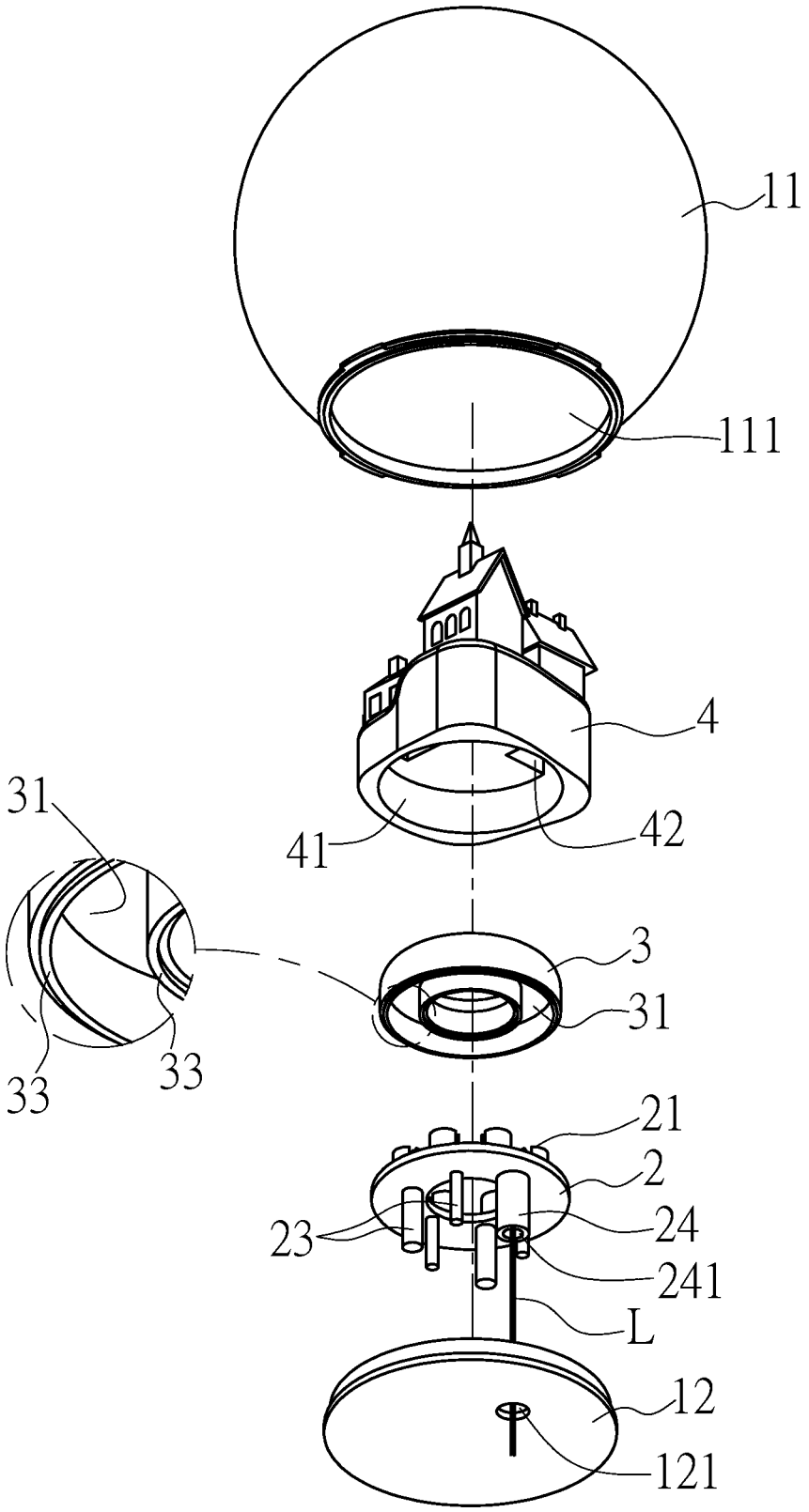
FIG. 3 is another perspective break-down diagram showing the water lamp of FIG. 1.
Figure 4:
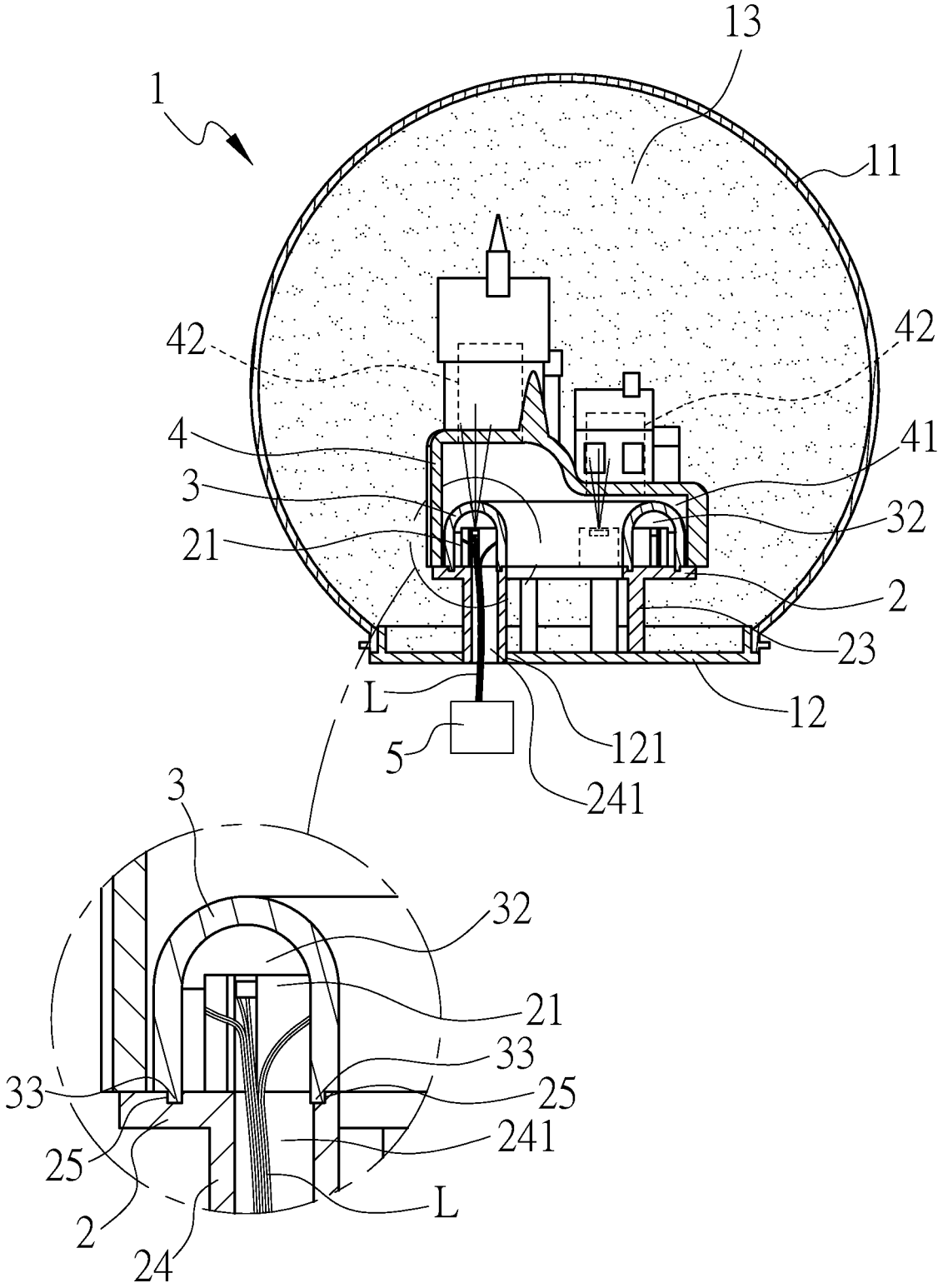
FIG. 4 is a schematic sectional diagram showing the water lamp of FIG. 1.

As shown in FIGS. 1 to 4, a water lamp according to an embodiment of the present invention includes a casing 1, a lighting member 2, a cap 3, and a decorative element 4.

The casing 1 includes a hollow and translucent container 11 with an opening 111, and a cover 12 sealing the opening 111. The container 11 and the cover 12 jointly enclose an accommodation space 13. The cover 12 has a through hole 121. The accommodation space 13 is filled with a fluid. In present embodiment, the container 11 has a generally spherical shape but the present invention is not limited as such. The container 11 may has a cubical, ellipsoidal, polyhedron, or other shape. The fluid may also be mixed with glittering powders or sequins so as to provide visual variations when the fluid flows.

The lighting member 2 is positioned inside the accommodation space 13 of the casing 1. The lighting member 2 has a number of pins 21 arranged at intervals on a top side of the lighting member 2, each with a lighting element 22 mounted on a top tip. There is no limitation on the number of pins 21 and the lighting elements 22, but there should be at least one of them. The lighting elements 22 are preferably LEDs. The lighting member 2 has a number of columns arranged at intervals and a tube 24 on a bottom side. The columns 23 have their bottom ends fixedly joined to the cover 12, and the tube 24 is extended through the through hole 121 so that the tube 24 tightly fills the through hole 121. Additionally, adhesive may be applied between the tube 24 and the through hole 121 to prevent the fluid from escaping through the through hole 121.

The tube 24 has an axial channel 241 so that a cable L may run through and connect the lighting elements 22 to a power element 5 or to a plug, a USB connector, or other connector for connecting to mains, a computer, a battery, or other power source. The power element 5 may be an internal power source with a switch. The present invention does not limit the shape of the lighting member 2, and the lighting member 2 has a ring shape in the present embodiment.

The cap 3 is made of a translucent, preferably transparent, material. In the present embodiment, the cap 3 also has a ring shape compatible to that of the lighting member 2, but it is not limited as such. The cap 3 has an open bottom 31 and, through the open bottom 31, the top side of the lighting member 2 is received in the cap 3. The cap 3 and the lighting member 2 as such jointly enclose a watertight space 32. To guarantee water tightness, the lighting member 2 has two ditches 25 on the top side. The cap 3's bottom side has two ring walls 33 respectively plugged into the ditches 25 with adhesive optionally applied therebetween. The lighting elements 22, the pins 21, and the channel 241 are enclosed in the watertight space 32, partitioned from the fluid in the accommodation space 13.

The decorative element 4 has a translucent three-dimensional shape which may include animals, plants, people, texts, or objects. In the present embodiment, the decorative element 4 presents several houses. A bottom side of the decorative element 4 is indented into a chamber 41 for covering and joining onto the cap 3. A top wall of the chamber 41 has a number of through holes 42, allowing light from the lighting elements 22 to pass through and illuminating the decorative element 4. In the meantime, light from the lighting elements 22 is also scattered by the flowing fluid, thereby creating appealing visual effect.

Figure 5:
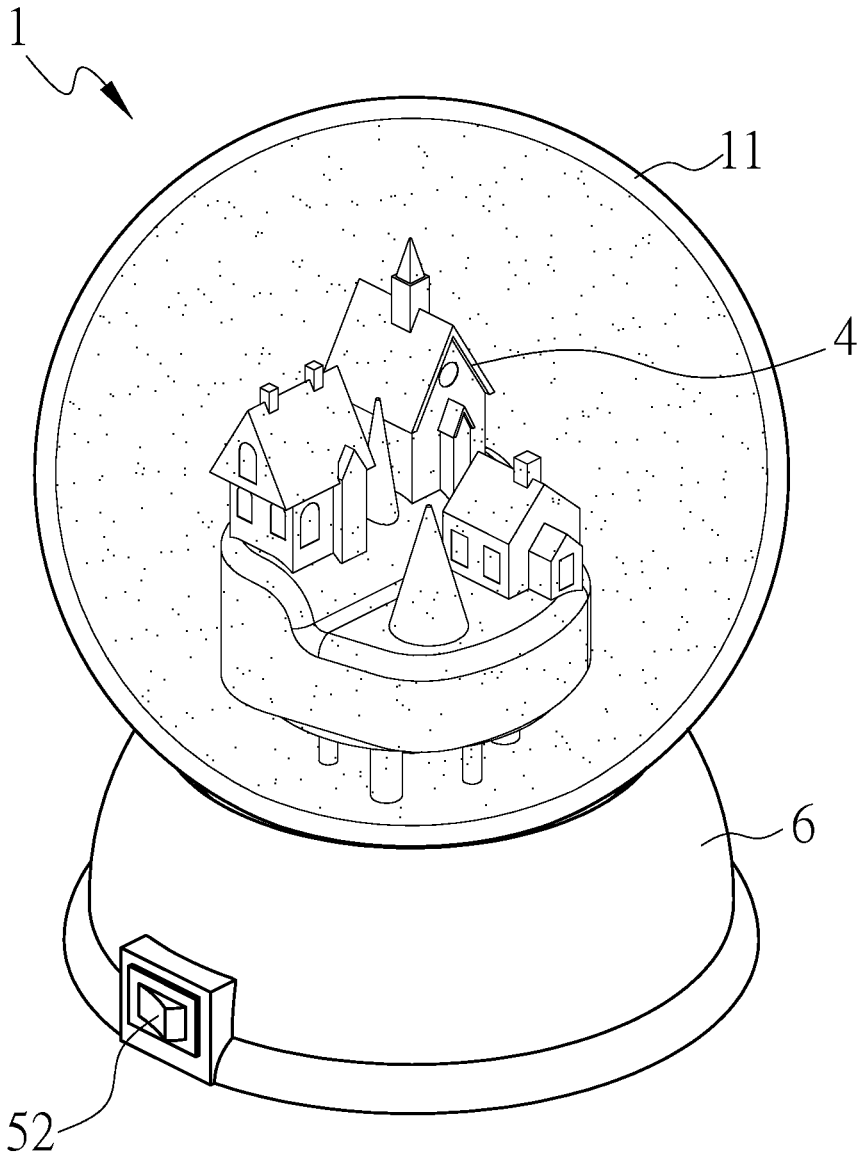
FIG. 5 is a perspective diagram showing a water lamp according to an embodiment of the present invention.
Figure 6:
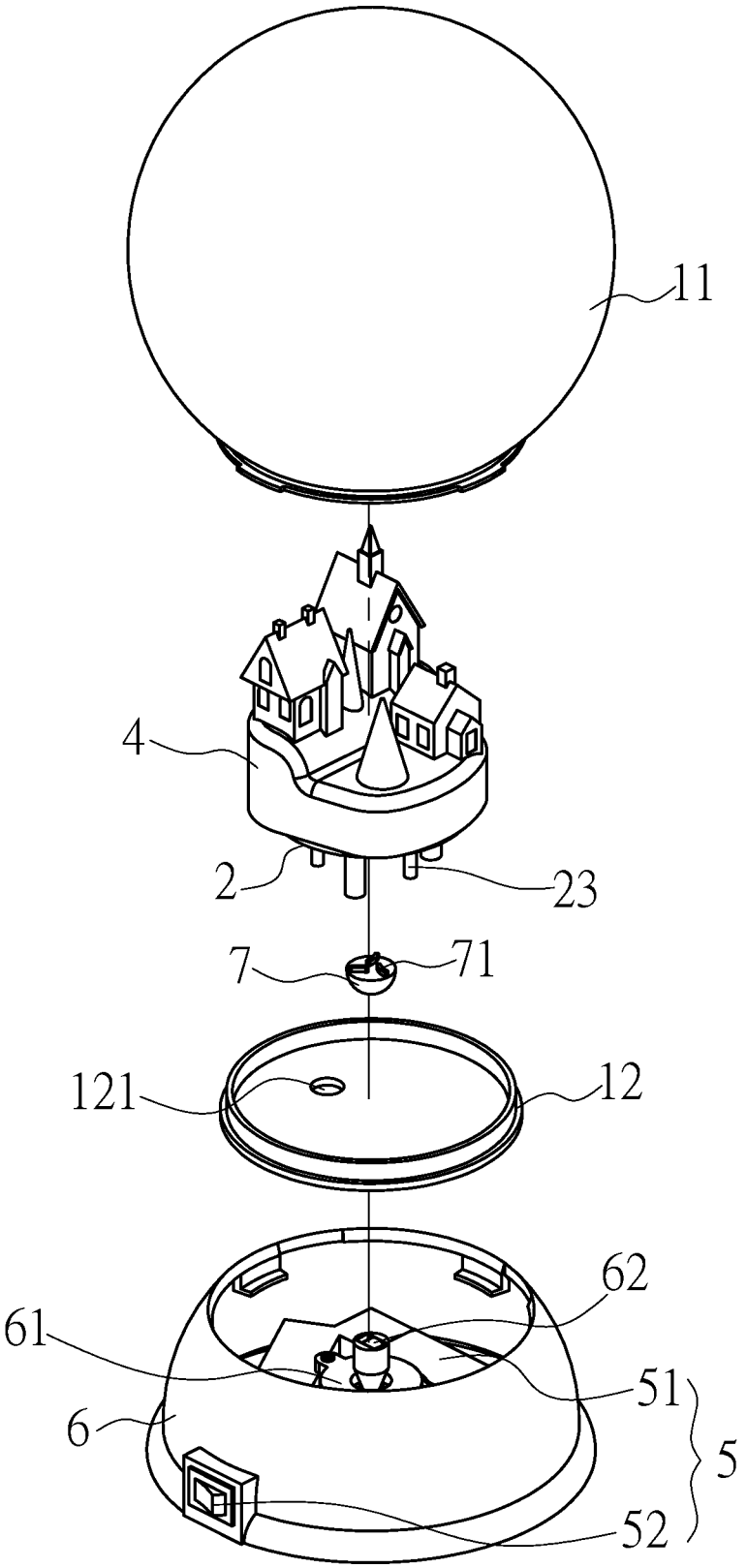
FIG. 6 is a perspective break-down diagram showing the water lamp of FIG. 5.
Figure 7:
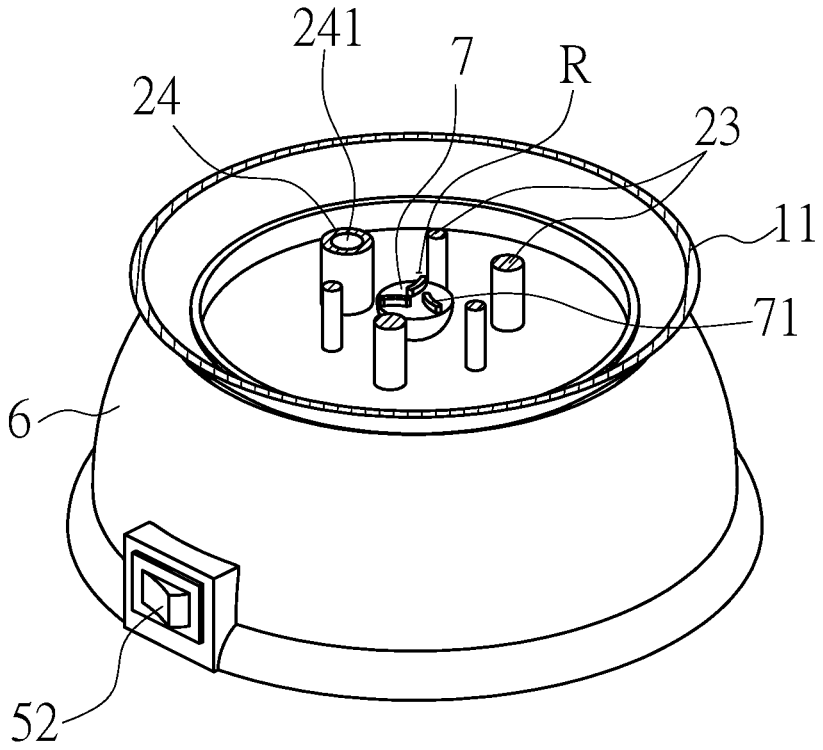
FIG. 7 is another perspective break-down diagram showing the water lamp of FIG. 5.
Figure 8:
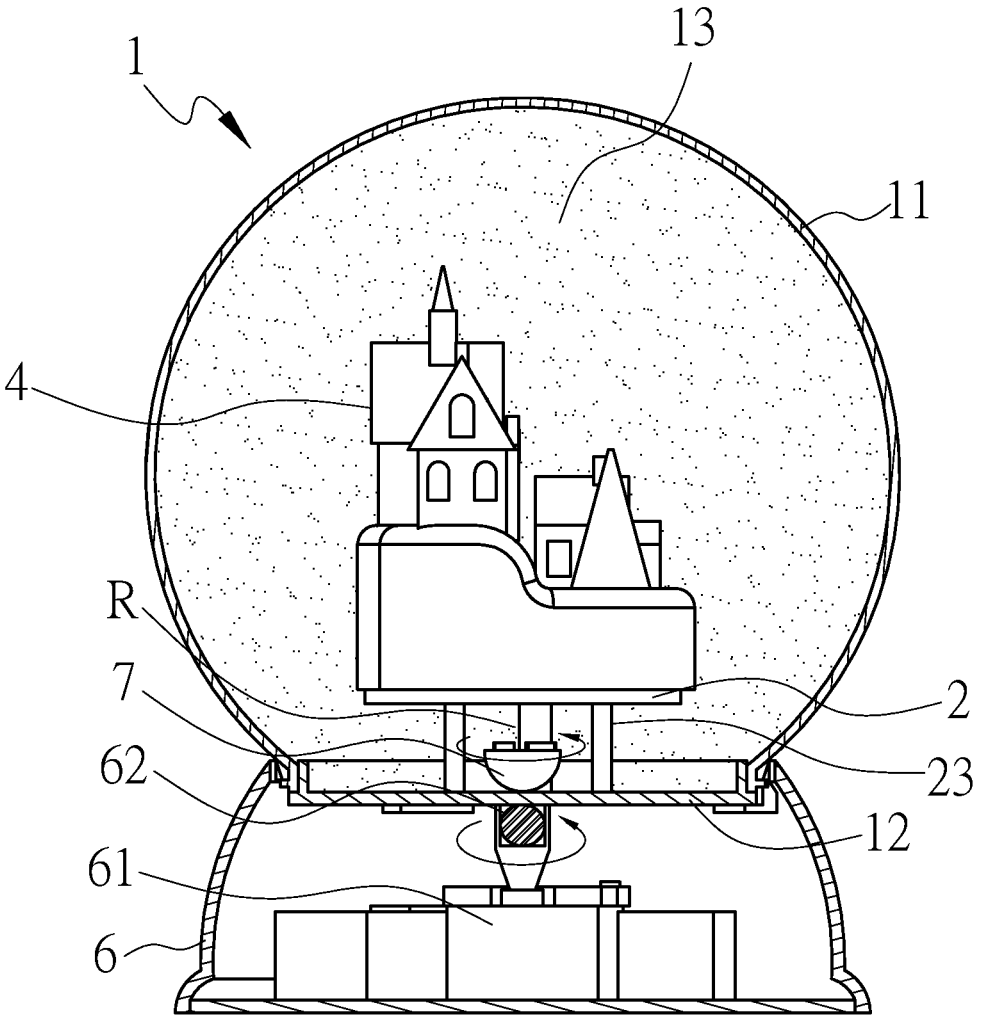
FIG. 8 is a schematic sectional diagram showing the water lamp of FIG. 5.
Figure 9:
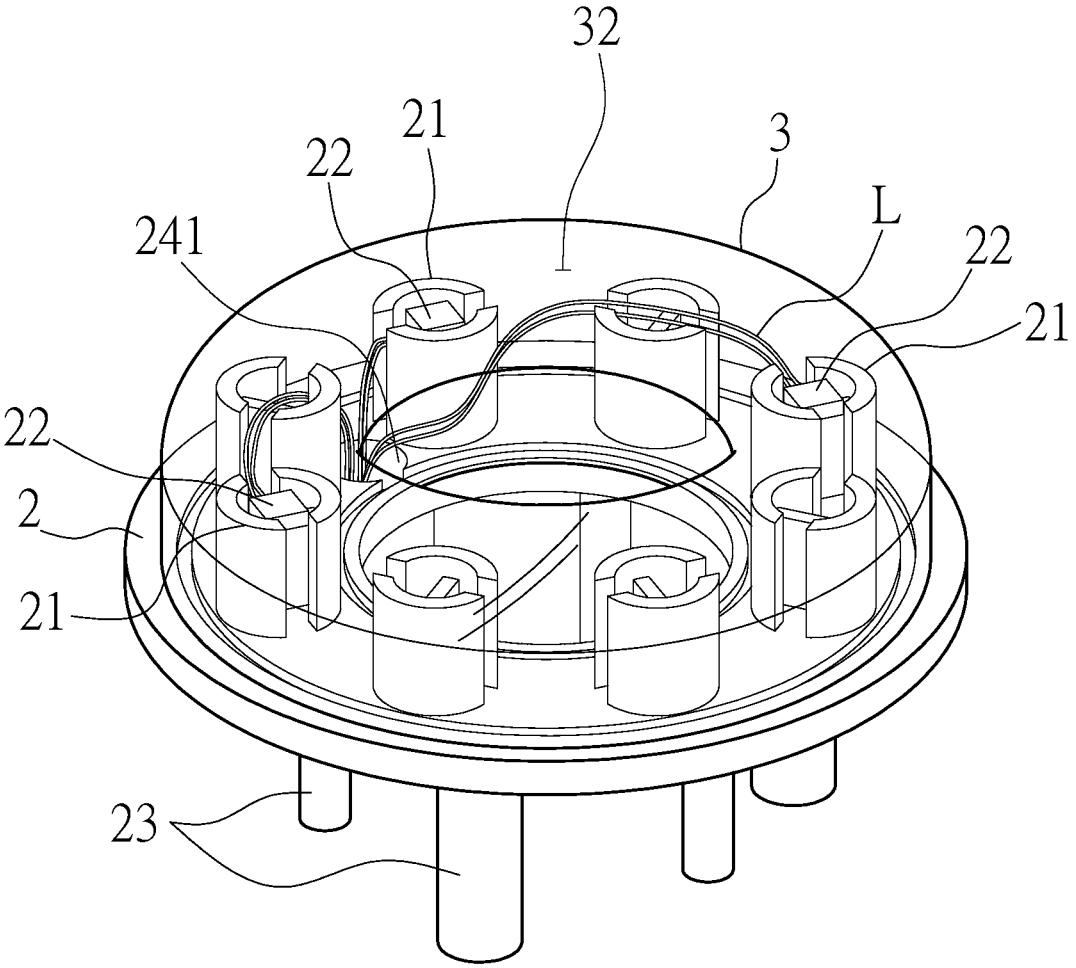
FIG. 9 is a schematic perspective diagram showing a lighting member and a cap of the water lamp of FIGS. 1 and 5.

As shown in FIGS. 5 to 8, a water lamp according to another embodiment of the present invention is similar to the previous one except that the present embodiment further includes a base 6 and a magnetic element 7. The base 6 supports the casing 1 from below and the power element 5 is housed inside the base 6. The power element 5 includes a circuit board 51 and a switch 52. The cable L connecting the lighting elements 22 and the switch 52 are electrically connected to the circuit board 51. By operating the switch 52 to turn on the power source 5, the circuit board 51 may turn on or off the lighting elements 22, control the sequence and durations of their on/off, and change their colors.

In the present embodiment, the base 6 includes a motor 61 and a magnetic axle 62 driven and rotated by the motor 61. The columns 23 and the tube 24 jointly surround an area R within which the magnetic element 7 is positioned. The magnetic element 7 is attracted and spins along with the magnetic axle 62. The magnetic element 7 has a number of radially arranged paddles 71 to disturb the fluid, as well as the mixed glittering powders and sequins, when the magnetic element 7 spins, thereby enhancing the water lamp's visual appealing.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A water lamp, comprising:

a translucent casing having an accommodation space inside filled with a fluid and a through opening on a bottom side;

a lighting member positioned in the accommodation space, comprising at least one lighting element on a top side and a plurality of columns and a tube arranged at intervals on a bottom side, where the columns have their bottom ends fixedly joined to a cover, and the tube is extended through and tightly fills a through hole, the tube has an axial channel, and a cable runs through and connects the at least one lighting elements to a power element;

a translucent cap having an open bottom receiving the top side of the lighting member, where the cap and the lighting member jointly enclose a watertight space, and the at least one lighting element and the channel are enclosed in the watertight space; and a translucent decorative element having a three-dimensional shape having a chamber on a bottom side for covering and joining onto the cap.

2. The water lamp according to claim 1, wherein the casing comprises a translucent container with an opening on the bottom side and the cover sealing the opening; and the through hole is provided on the cover.

3. The water lamp according to claim 1, wherein the lighting member further comprises at least one pin; and the at least one lighting element is positioned at a top tip of the at least one pin.

4. The water lamp according to claim 1, wherein the lighting member has two ditches on the top side; the cap's bottom side has two ring walls respectively plugged into the ditches.

5. The water lamp according to claim 1, wherein the power element is a power source with a switch.

6. The water lamp according to claim 1, further comprising a base supporting the casing from below and a magnetic element, wherein the power element comprises a circuit board housed inside the base; the base comprises a motor and a magnetic axle rotated by the motor; the columns and the tube jointly surround an area within which the magnetic element is positioned; and the magnetic element is attracted and spins along with the magnetic axle.

7. The water lamp according to claim 1, wherein each lighting element is a light emitting diode (LED).

* * * * *